US011181311B2

(12) United States Patent
Jung et al.

(10) Patent No.: US 11,181,311 B2
(45) Date of Patent: Nov. 23, 2021

(54) REFRIGERATOR AND METHOD OF CONTROLLING THE SAME

(71) Applicant: LG ELECTRONICS INC., Seoul (KR)

(72) Inventors: Changyoon Jung, Seoul (KR); Yunsu Cho, Seoul (KR)

(73) Assignee: LG ELECTRONICS, INC., Seoul (KR)

( * ) Notice: Subject to any disclaimer, the term of this patent is extended or adjusted under 35 U.S.C. 154(b) by 106 days.

(21) Appl. No.: 16/695,805

(22) Filed: Nov. 26, 2019

(65) Prior Publication Data

US 2020/0166269 A1 May 28, 2020

(30) Foreign Application Priority Data

Nov. 27, 2018 (KR) ..... 10-2018-0148389

(51) Int. Cl.
*F25D 21/00* (2006.01)
*F25D 11/02* (2006.01)

(52) U.S. Cl.
CPC ..... *F25D 21/006* (2013.01); *F25D 11/02* (2013.01); *F25D 21/008* (2013.01)

(58) Field of Classification Search
CPC ..... F25D 21/006; F25D 21/008; F25D 21/002
See application file for complete search history.

(56) References Cited

U.S. PATENT DOCUMENTS 4,145,893 A 3/1979 Vogel
4,392,358 A * 7/1983 Hicks ..... F25D 21/008 62/128
5,551,248 A * 9/1996 Derosier ..... F25B 49/02 62/155
5,842,355 A * 12/1998 Kalis ..... F25D 17/062 62/234
5,887,443 A * 3/1999 Lee ..... F25D 21/002 62/153
6,205,800 B1 * 3/2001 Topper ..... A47F 3/0404 62/156
6,370,895 B1 * 4/2002 Sakuma ..... F25D 11/022 62/199

(Continued)

FOREIGN PATENT DOCUMENTS

CN 105387665 A 3/2016
CN 105509402 A 4/2016

(Continued)

*Primary Examiner* — Nelson J Nieves
(74) *Attorney, Agent, or Firm* — Dentons US LLP

(57) ABSTRACT

The present disclosure provides a method of controlling a refrigerator that includes a compressor, an evaporator to supply cold air to a storage chamber, a defrosting heater to defrost the evaporator, and a controller to control the defrosting heater. The method includes: operating a cooling cycle for cooling the storage chamber; determining whether a defrosting start condition is satisfied during operation of the cooling cycle; determining whether a defrosting delay condition is satisfied when the defrosting start condition is satisfied; and starting a defrosting operation when the defrosting delay condition is not satisfied, and starting the defrosting operation at a delayed defrosting start time when the defrosting delay condition is satisfied.

18 Claims, 8 Drawing Sheets

(56) References Cited

U.S. PATENT DOCUMENTS 6,415,616 B1* 7/2002 Kim ..... F25D 21/002 62/155
2002/0139130 A1* 10/2002 Collins ..... F25D 21/002 62/155
2002/0184900 A1* 12/2002 Wellman ..... A47F 3/0469 62/155
2003/0140639 A1* 7/2003 Gray ..... F25D 21/002 62/157
2005/0066667 A1 3/2005 Strauss
2005/0120727 A1* 6/2005 Flinner ..... F25D 21/02 62/126
2007/0283706 A1* 12/2007 Kang ..... F25D 21/12 62/156
2007/0295015 A1* 12/2007 Bailey ..... F25D 21/006 62/150
2009/0217684 A1* 9/2009 Ouchi ..... F25D 21/002 62/155
2011/0289945 A1* 12/2011 Choi ..... F25D 29/00 62/80
2012/0266615 A1* 10/2012 Coussey ..... B64D 13/08 62/80
2013/0042638 A1* 2/2013 Eom ..... G01N 29/48 62/80
2013/0081416 A1* 4/2013 Kim ..... F25D 21/02 62/151
2013/0086928 A1* 4/2013 Cho ..... F25D 21/006 62/80
2014/0053581 A1* 2/2014 Cho ..... F25D 21/006 62/80
2014/0137580 A1 5/2014 Peyaud et al.
2014/0150479 A1* 6/2014 Qu ..... F25B 47/025 62/80
2015/0047380 A1 2/2015 Liao
2015/0211779 A1* 7/2015 Brandt ..... F24F 11/30 62/80
2016/0084565 A1* 3/2016 DeVos ..... F25D 21/04 62/80
2016/0223236 A1* 8/2016 Kimura ..... F25B 49/02
2018/0238603 A1* 8/2018 Takami ..... F25D 21/04
2019/0120536 A1* 4/2019 Qiu ..... F25D 29/003
2019/0128590 A1* 5/2019 Kojima ..... F25B 13/00
2020/0158392 A1* 5/2020 Tomiyama ..... F25B 13/00
2020/0393179 A1* 12/2020 Kim ..... F25B 41/20
2021/0080161 A1* 3/2021 Tashiro ..... F25B 41/26

FOREIGN PATENT DOCUMENTS

CN 107940873 A 4/2018
CN 108885050 A 11/2018
DE 648795 C 8/1937
DE 4115359 C2 7/1997
DE 10221904 A1 12/2003
DE 10311343 A1 9/2004
GN 1653307 A 8/2005
GN 108151424 A 6/2018
JP H07-260325 A 10/1995
JP 2014-035151 A 2/2014
KR 10-2000-0004806 A 1/2000

* cited by examiner

FIG. 4

| Door open | O | O | O | X | X | X | X | O | O |
|---|---|---|---|---|---|---|---|---|---|
| Operation state | Normal | Normal | Normal | Power saving | Power saving | Power saving | Power saving | Normal | Normal |

REFRIGERATOR AND METHOD OF CONTROLLING THE SAME

CROSS REFERENCE TO RELATED APPLICATION

The present application claims priority to Korean Patent Application No. 10-2018-0148389, filed Nov. 28, 2018, the entire contents of which is incorporated herein by reference for all purposes.

BACKGROUND

Field

The present disclosure relates to a refrigerator and a method of controlling the refrigerator.

Background

A refrigerator is a home appliance that can keep objects such as food at low temperature in a storage chamber of a cabinet. The storage chamber is surrounded with insulating walls, so that the inside of the storage chamber can be maintained at temperature lower than external temperature.

The storage chamber may be classified into a refrigerating compartment or a freezing compartment, depending on the temperature range of the storage chamber.

The refrigerator may include an evaporator that supplies cold air to the storage chamber. The air in the storage chamber flows into the space where the evaporator is disposed, and is then cooled by exchanging heat with the evaporator, and the cooled air is supplied back into the storage chamber.

When the air that exchanges heat with the evaporator contains water, the water condenses on the surface of the evaporator when the air exchanges heat with the evaporator, whereby frost is produced on the surface of the evaporator.

The frost acts as resistance against airflow, so the larger the amount of the frost that condenses on the surface of the evaporator, the larger the resistance against flow by the frost, thereby decreasing the heat exchange efficiency and increasing the power consumption of the evaporator.

Accordingly, the refrigerator further includes a defroster that removes frost on the evaporator.

A method of adjusting a defrosting cycle is disclosed in Korean Patent Application Publication No. 2000-0004806.

In the publication, a defrosting cycle is adjusted using an accumulated operation time of a compressor and temperature of external air.

However, when a defrosting cycle is determined using only the accumulated operation time of a compressor and the temperature of external air, there is a problem that the actual amount of frost (hereafter, referred to as a "frosting amount") on an evaporator is not reflected, so there is a defect in that it is difficult to accurately determine the point in time in which defrosting is actually required based on this defrosting cycle.

That is, the defrosting amount on an evaporator may be large or small, depending on various environments such as the use pattern of a refrigerator by a user and the amount of water contained in the air. But, there is a defect in the defrosting cycle of the publication because the defrosting cycle is determined without reflecting these various environments.

Accordingly, there is a defect in that defrosting may be unnecessarily started in spite of a small frosting amount, whereby unnecessary power is consumed due to the defrosting cycle.

SUMMARY

An embodiment may provide a refrigerator that prevents an increase in power consumption due to unnecessary defrosting by delaying start of defrosting when defrosting delay is possible even if the defrosting start condition is satisfied, and a method of controlling the refrigerator.

An embodiment provides a refrigerator that may prevent an unnecessary increase in power consumption during a post-defrosting operation by determining the cooling power of the compressor on the basis of a refrigerator use pattern of a user after a defrosting operation is finished, and a method of controlling the refrigerator.

According to an aspect, a method of controlling a refrigerator, which includes a compressor, an evaporator configured to supply cold air to a storage chamber, a defrosting heater operating to defrost the evaporator, and a controller configured to control the defrosting heater, may include: operating a cooling cycle for cooling the storage chamber; determining whether a defrosting start condition is satisfied during operation of the cooling cycle by means of the controller; determining whether a defrosting delay condition is satisfied by means of the controller when the defrosting start condition is satisfied; and immediately starting a defrosting operation when the defrosting delay condition is not satisfied, and starting the defrosting operation at a delayed defrosting start time when the defrosting delay condition is satisfied.

In this embodiment, a case in which the defrosting start condition is satisfied may be a case in which an accumulated operation time of the cooling cycle reaches a defrosting reference time.

In this embodiment, the defrosting reference time may be reduced on a basis of an opening time of a door configured to open and close the storage chamber, and the case in which the defrosting start condition is satisfied may be a case in which the accumulated operation time of the cooling cycle reaches a reduced reference time.

In this embodiment, the refrigerator may further include: an evaporator sensor configured to sense temperature of the evaporator or temperature around the evaporator; and a temperature sensor configured to sense temperature of the storage chamber.

In this case, the case in which the defrosting delay condition is satisfied may be a case in which a difference between temperature of the storage chamber sensed by the temperature sensor and temperature sensed by the evaporator sensor is less than a reference temperature value.

Alternatively, the refrigerator may further include an evaporator sensor configured to sense temperature of the evaporator or temperature around the evaporator. In this case, the compressor may be turned on or off during an operation of the cooling cycle, and a case in which the defrosting delay condition is satisfied may be a case in which a difference between temperature of the evaporator sensor at the point in time when the compressor is turned on and temperature of the evaporator sensor at the point in time when the compressor is turned off is less than a reference temperature value.

In this embodiment, the controller may determine the delayed defrosting start time within a predetermined maximum delay time range.

The controller may determine the delayed defrosting start time within a time period after a minimum delay time period in the maximum delay time range. The length of the minimum delay time may be ½ of the length of the maximum delay time.

The refrigerator may further include a memory in which an operation state of the refrigerator for each unit time is stored on a basis of opening information of the door.

A power saving operation state or a normal operation state of the refrigerator for each unit time may be stored in the memory.

In this embodiment, the controller may determine the delayed defrosting start time such that a defrosting operation is started in a period in which power saving periods continuously exist.

When a power saving period does not continuously exist in a time period after the minimum delay time period, the controller may control the defrosting operation to be started immediately after the maximum delay time elapses.

The defrosting operation may include a pre-defrosting step and a defrosting step. In the defrosting step, the defrosting heater may be operated.

The method of controlling a refrigerator of this embodiment may further include: determining whether the defrosting operation is finished; and performing a post-defrosting operation when the defrosting operation is finished.

In this embodiment, the controller may control the compressor such that the compressor operates with cooling power lower than maximum cooling power during the post-defrosting operation.

When opening of a door of the storage chamber is sensed while the compressor operates with a cooling power lower than the maximum cooling power, the controller may control the compressor such that the compressor operates with the maximum cooling power.

In this embodiment, when the point in time when the defrosting operation is finished is a power saving operation period and the next period is also a power saving operation period, the controller may control the compressor such that the compressor is operated with cooling power lower than the maximum cooling power during the post-defrosting operation.

In this embodiment, when the post-defrosting operation is started in the normal operation period or when the post-defrosting operation is started in the power saving operation period but a next period is a normal operation period, the controller may control the compressor such that the compressor operates with the maximum cooling power.

A refrigerator according to another aspect may include: an evaporator configured to supply cold air to a storage chamber; a defrosting heater operating to defrost the evaporator; and a controller configured to control the defrosting heater.

The controller may determine whether a defrosting start condition is satisfied, and may determine whether a defrosting delay condition is satisfied when the defrosting start condition is satisfied.

The controller may immediately start a defrosting operation when the defrosting delay condition is not satisfied, and may determine a delayed defrosting start time and start the defrosting operation at the delayed defrosting start time when the defrosting delay condition is satisfied.

BRIEF DESCRIPTION OF THE DRAWINGS

Various aspects, features and other advantages of the present disclosure will be more clearly understood from the following detailed description when taken in conjunction with the accompanying drawings, in which:

FIG. 4 is a view showing operation states for respective unit times stored in a memory according to an embodiment of the present disclosure;

DETAILED DESCRIPTION OF EMBODIMENTS

Figure 1:
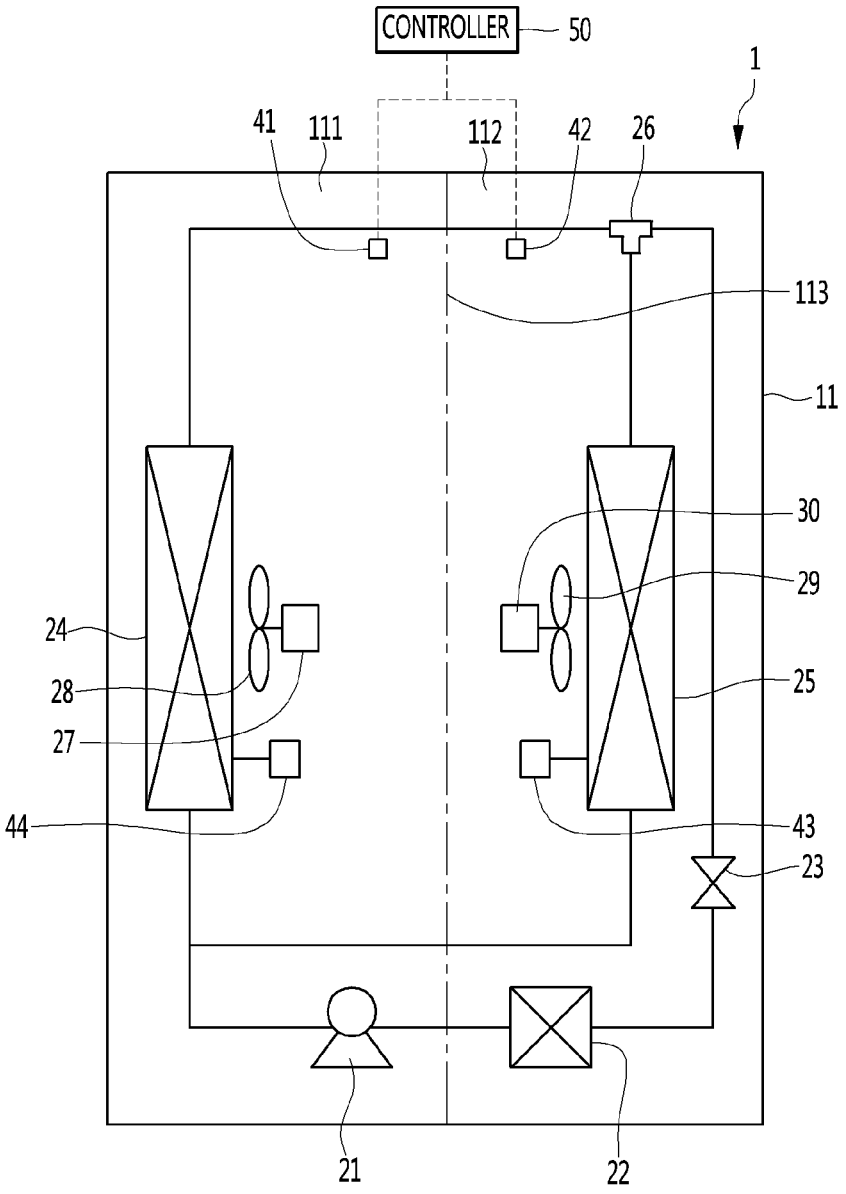
FIG. 1 is a view schematically showing the configuration of a refrigerator according to an embodiment of the present disclosure.

Hereinafter, embodiments of the present disclosure are described in detail with reference to exemplary drawings. It should be noted that when components are given reference numerals in the drawings, the same or similar components may be given the same reference numerals even if they are shown in different drawings. Further, in the following description of embodiments of the present disclosure, when detailed description of well-known configurations or functions is determined as interfering with the understanding of the embodiments of the present disclosure, they may not be described in detail or may be omitted.

Further, terms "first", "second", "A", "B", "(a)", and "(b)" may be used in the following description of the components of embodiments of the present disclosure. The terms are provided only for discriminating components from other components and, the essence, sequence, or order of the components are not limited by the terms. When a component is described as being "connected", "combined", or "coupled" with another component, it should be understood that the component may be connected or coupled to another component directly or with another component interposing therebetween.

Figure 2:
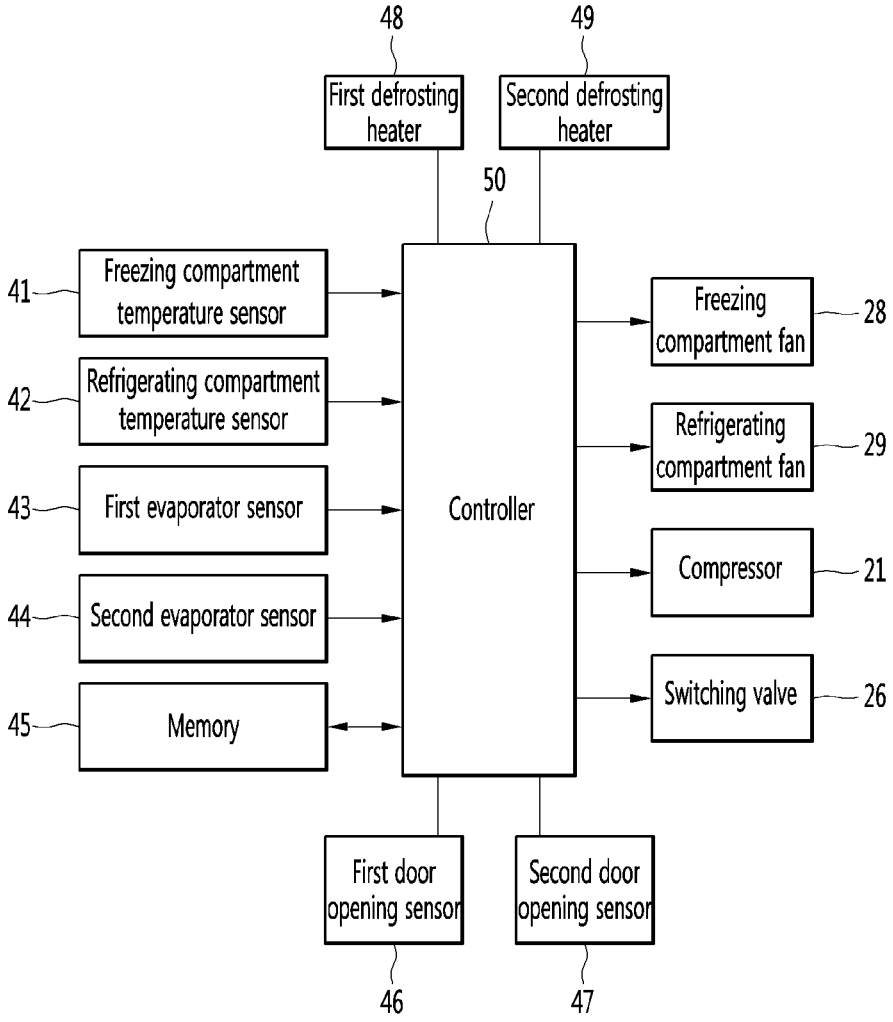
FIG. 2 is an electrical schematic diagram of a refrigerator according to an embodiment of the present disclosure.

FIG. 1 is a view schematically showing the configuration of a refrigerator according to an embodiment of the present disclosure; and FIG. 2 is an electrical schematic diagram of a refrigerator according to an embodiment of the present disclosure.

Referring to FIGS. 1 and 2, a refrigerator 1 according to an embodiment of the present disclosure may include a cabinet 11 having a freezing compartment 111 and a refrigerating compartment 112 therein and a door (not shown) coupled to the cabinet 11 to open and close each of the freezing compartment 111 and the refrigerating compartment 112.

The freezing compartment 111 and the refrigerating compartment 112 may be horizontally or vertically partitioned within the cabinet 11 by a partition wall 113. In the present embodiment, the freezing compartment 111 and the refrigerating compartment 112 is vertically partitioned.

The refrigerator 1 may further include a compressor 21, a condenser 22, an expansion member 23, an evaporator 24 for a freezing compartment (or referred to as a "first evaporator") to generate cold air for cooling the freezing compartment 111, and an evaporator 25 for a refrigerating compartment (or referred to as a "second evaporator) to generate cold air for cooling the refrigerating compartment 112.

The refrigerator 1 may include a switching valve 26 for allowing the refrigerant passing through the expansion member 23 to flow to one of the evaporator 24 for the freezing compartment or the evaporator 25 for the refrigerating compartment.

In the present embodiment, the state in which the switching valve 26 operates so that the refrigerant flows to the evaporator 24 for the freezing compartment may be referred to as a first state of the switching valve 26. Also, the state in which the switching valve 26 operates so that the refrigerant flows to the evaporator 25 for the refrigerating compartment may be referred to as a second state of the switching valve 26. The switching valve 26 may be, for example, a three way valve.

The switching valve 26 selectively opens one of a first refrigerant passage connected between the compressor 21 and the evaporator 25 to allow the refrigerant to flow therebetween and a second refrigerant passage connected between the compressor 21 and the evaporator 24 to allow the refrigerant to flow therebetween. The cooling of the refrigerating compartment 112 and cooling of the freezing compartment 111 may be alternately operated using the switching valve 26.

The refrigerator 1 may include a freezing compartment fan 28 (referred to as a "first fan") for blowing air to the evaporator 24 for the freezing compartment, a first motor 27 for rotating the freezing compartment fan 28, a refrigerating compartment fan 29 (referred to as a "second fan") for blowing air to the evaporator 25 for the refrigerating compartment, and a second motor 30 for rotating the refrigerating compartment fan 29.

In the present embodiment, a series of cycles in which the refrigerant flows to a compressor 21, a condenser 22, an expansion member 23, and the evaporator 24 for the freezing compartment is referred to as a "freezing cycle", and a series of cycles in which the refrigerant flows to the compressor 21, the condenser 22, the expansion member 23, and the evaporator 25 for the refrigerating compartment is referred to as a "refrigerating cycle".

The "the refrigerating cycle is operated" means that the compressor 21 is turned on, the refrigerating compartment fan 29 is rotated, and, while the refrigerant flows in the evaporator 25 for the refrigerating compartment through the switching valve 26, the refrigerant flowing in the evaporator 25 for the refrigerating compartment is heat-exchanged with air.

Further, "the freezing cycle is operated" means that the compressor 21 is turned on, the freezing compartment fan 29 is rotated, and, while the refrigerant flows in the evaporator 24 for the freezing compartment through the switching valve 26, the refrigerant flowing in the evaporator 24 for the freezing compartment is heat-exchanged with air.

Although one expansion member 23 is disposed at an upstream side of the switching valve 26 as described above, a first expansion member may be disposed between the switching valve 26 and the evaporator 24 for the freezing compartment, and a second expansion member may be disposed between the switching valve 26 and the evaporator 25 for the refrigerating compartment.

In another example, a first valve (or freezing compartment valve) may be disposed at an inlet side of the evaporator 24 for the freezing compartment, and a second valve (or refrigerating compartment valve) may be disposed at an inlet side of the evaporator 25 for the refrigerating compartment without using the switching valve 26. Also, while the freezing cycle operates, the first valve may be turned on, and the second valve may be turned off. When the refrigerating cycle operates, the first valve may be turned off, and the second valve may be turned on.

The refrigerator 1 may further include a freezing compartment temperature sensor 41 for sensing a temperature of the freezing compartment 111, a refrigerating compartment temperature sensor 42 for sensing a temperature of the refrigerating compartment 112, an input unit 43 and 44 for inputting a target temperature (or a desired temperature) of each of the freezing compartment 111 and the refrigerating compartment 112, and a controller 50 for controlling the cooling cycle (including the freezing cycle and the refrigerating cycle) on the basis of the inputted target temperature and the temperatures sensed by the temperature sensors 41 and 42.

In the specification, temperature that is lower than the target temperature of the freezing compartment 111 may be referred to a first freezing compartment reference temperature (or a third reference temperature), and temperature that is higher than the target temperature of the freezing compartment 111 may be referred to a second freezing compartment reference temperature (or a fourth reference temperature). The range between the first freezing compartment reference temperature and the second freezing compartment reference temperature may be referred to as a freezing compartment setting temperature range.

Though not limited, the target temperature of the freezing compartment 111 may be the average temperature between the first freezing compartment reference temperature and the second freezing compartment reference temperature.

In the specification, temperature that is lower than the target temperature of the refrigerating compartment 112 may be referred to a first refrigerating compartment reference temperature (or a first reference temperature), and temperature that is higher than the target temperature of the refrigerating compartment 112 may be referred to a second refrigerating compartment reference temperature (or a second reference temperature). The range between the first refrigerating compartment reference temperature and the second refrigerating compartment reference temperature may be referred to as a refrigerating compartment setting temperature range.

Though not limited, the target temperature of the refrigerating compartment 112 may be the average temperature between the first refrigerating compartment reference temperature and the second refrigerating compartment reference temperature.

A user may set the target temperatures of the freezing compartment 111 and the refrigerating compartment 112 in this embodiment.

The controller 50 may control the temperature of the refrigerating compartment 112 to be maintained within a temperature satisfaction section pertaining to the refrigerating compartment setting temperature range. Alternatively, the controller 50 may control the temperature of the freezing compartment 111 to be maintained within a temperature satisfaction section pertaining to the freezing compartment setting temperature range.

The upper limit temperature of the temperature satisfaction section may be set lower than the second refrigerating compartment reference temperature and a lower limit temperature may be set higher than the first refrigerating compartment reference temperature.

In this embodiment, the controller 50 may control a refrigerating cycle, a freezing cycle, and a pump-down operation to make one operation cycle. Alternatively, the compressor 21 may be stopped after the pump-down operation.

In this embodiment, the pump-down operation means an operation that collects refrigerants remaining in a plurality of evaporators by operating the compressor 21 with refrigerant supply to all the evaporators stopped.

The controller 50 may operate the refrigerating cycle, and when a stop condition of the refrigerating cycle (which may be considered as a start condition of a freezing cycle) is satisfied, the controller 50 may operate the freezing cycle. When the stop condition of the refrigerating cycle is satisfied while the freezing cycle is operated, it is possible to perform the pump-down operation.

In this embodiment, the pump-down operation may be omitted in a specific condition. In this case, the refrigerating cycle and the freezing cycle may be alternately operated. In this case, the refrigerating cycle and the freezing cycle may make one operation cycle.

For example, the pump-down operation may be omitted when temperature of external air is low.

Meanwhile, the refrigerator 1 may further include a memory 45 in which the temperatures of the freezing compartment 111 and the refrigerating compartment 112 are stored while a cooling cycle is operated.

The refrigerator 1 may further include a first defrosting heater 48 that defrosts the evaporator 24 for the freezing compartment and a second defrosting heater 49 that defrosts the evaporator 25 for the refrigerating compartment.

The refrigerator 1 may further include a first evaporator sensor 43 that senses temperature of the evaporator 24 for the freezing compartment or temperature around the evaporator 24 for the freezing compartment, and a second evaporator sensor 44 that senses temperature of the evaporator 25 for the refrigerating compartment or temperature around the evaporator 25 for the refrigerating compartment.

The refrigerator 1 may further include a first door opening sensor 46 that senses opening of the freezing compartment door and a second door opening sensor 47 that senses opening of the refrigerating compartment door.

When an accumulated operation time of the freezing cycle reaches a first reference time (a defrosting reference time), the controller 50 may determine that a defrosting start condition of the evaporator 24 for the freezing compartment is satisfied.

When opening of the freezing compartment door is sensed while the freezing cycle is operated, the first reference time may be decreased in proportion to the opening time of the freezing compartment door. In this embodiment, the decreased first reference time may be referred to as a shortened reference time.

For example, when the accumulated operation time of the freezing cycle reaches the first reference time without the freezing compartment door being opened while the freezing cycle is operated, the controller 50 may determine that the defrosting start condition of the evaporator 24 for the freezing compartment is satisfied.

However, when the freezing compartment door is opened one or more times while the freezing cycle is operated, and when the accumulated operation time of the freezing cycle reaches a third reference time (shortened reference time) that is smaller than the first reference time, the controller 50 may determine that the defrosting start condition of the evaporator 24 for the freezing compartment is satisfied.

Similarly, when an accumulated operation time of the refrigerating cycle reaches a second reference time (a defrosting reference time), the controller 50 may determine that a defrosting start condition of the evaporator 25 for the refrigerating compartment is satisfied.

When opening of the refrigerating compartment door is sensed while the refrigerating cycle is operated, the second reference time may be decreased in proportion to the opening time of the refrigerating compartment door. In this embodiment, the decreased second reference time may be referred to as a shortened reference time.

For example, when the accumulated operation time of the refrigerating cycle reaches the second reference time without the refrigerating compartment door being opened while the refrigerating cycle is operated, the controller 50 may determine that the defrosting start condition of the evaporator 25 for the refrigerating compartment is satisfied.

However, when the refrigerating compartment door is opened one or more times while the refrigerating cycle is operated, and when the accumulated operation time of the refrigerating cycle reaches a fourth reference time (shortened reference time) that is smaller than the second reference time, the controller 50 may determine that the defrosting start condition of the evaporator 25 for the refrigerating compartment is satisfied.

The defrosting operation methods of the evaporator 24 for the freezing compartment and the evaporator 25 for the refrigerating compartment may be applied in the same way in this embodiment.

Hereafter, the evaporator 24 for the freezing compartment and the evaporator 25 for the refrigerating compartment are, in combination, referred to as an evaporator. Further, the first defrosting heater 48 and the second defrosting heater 49 are, in combination, referred to as a defrosting heater, and the first evaporator sensor 43 and the second evaporator sensor 44 are, in combination, referred to as an evaporator sensor. The freezing compartment fan 28 and the refrigerating compartment fan 29 are, in combination, referred to as a fan.

In this embodiment, the defrosting operation may be divided into a pre-defrosting step and a defrosting step in which defrosting is actually performed.

The pre-defrosting step means an operation that decreases the temperature of the storage chamber before the defrosting heater is operated.

That is, since the temperature of the storage chamber increases when the defrosting heater is operated, the temperature of the storage chamber is decreased in advance in preparation for an increase in temperature of the storage chamber.

The pre-defrosting step may be composed of a plurality of steps. For example, the plurality of steps may include a first step to a third step.

In the first step, the speed of the fan may be increased in comparison to a normal operation during the operation of the cooling cycle. That is, the speed of the fan may be first revolutions per minute (RPM) during a normal cooling cycle and the speed of the fan in the first step in the defrosting operation may be second RPM greater than first RPM.

The first step may be ended when a limit time elapses, when the temperature of the storage chamber reaches temperature lower than a set temperature by a limit temperature, or when the temperature of external air reaches temperature, which is an external air reference temperature, or less.

In the second step, the compressor 21 may be turned off and the fan may be operated at third RPM greater than second RPM. The second step may be the pump-down operation described above.

In the third step, the compressor 21 may be turned off and the fan may be operated at fourth RPM less than the first RPM for a set time.

It should be noted that, in this embodiment, some steps of the detailed steps included in the pre-defrosting step may be omitted or replaced with other steps.

After the pre-defrosting step is finished, the defrosting step may be started.

In the defrosting step, the defrosting heater may be operated to melt frost on the evaporator.

When the temperature sensed at the evaporator reaches a defrosting end temperature while the defrosting heater is operated, the controller 50 may determine that defrosting has been finished.

However, in this embodiment, it should be noted that the method of determining that defrosting has been finished is not limited to what has been described above.

Hereafter, a method of controlling the refrigerator according to an embodiment is described.

Figure 3:
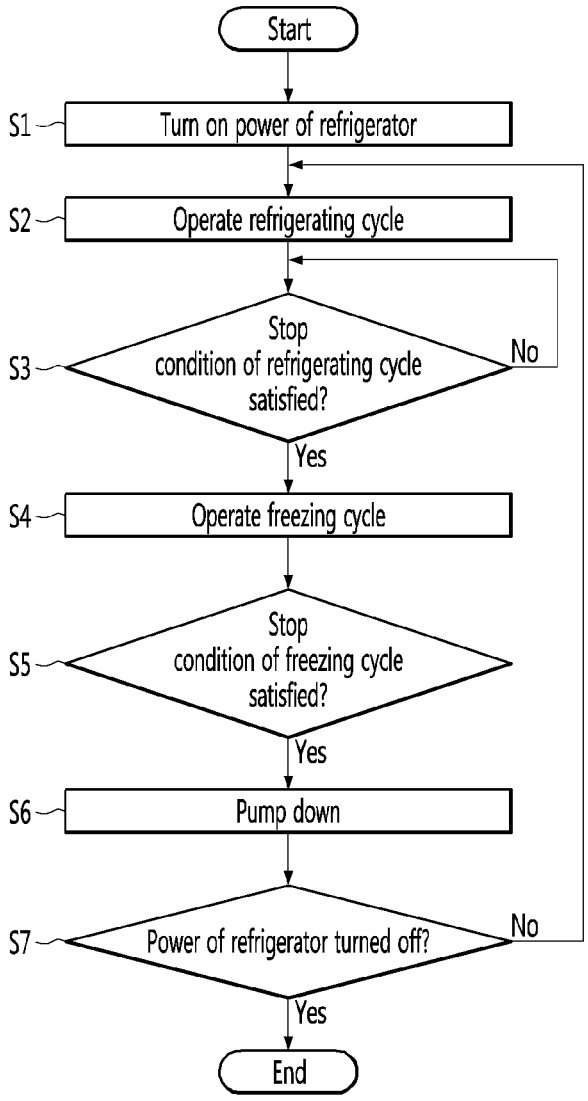
FIG. 3 is a flowchart schematically illustrating a method of controlling a refrigerator according to an embodiment of the present disclosure.

FIG. 3 is a flowchart schematically illustrating a method of controlling a refrigerator according to an embodiment of the present disclosure; and FIG. 4 is a view showing operation states for respective unit times stored in a memory according to an embodiment of the present disclosure.

First, referring to FIG. 3, the power of the refrigerator 1 is turned on (S1). When the power of the refrigerator 1 is turned on, the refrigerator 1 may be operated to cool the freezing compartment 111 or the refrigerating compartment 112.

Hereafter, a method of controlling the refrigerator when cooling the freezing compartment 111 after cooling the refrigerating compartment 112 is exemplified.

In order to cool the refrigerating compartment 112, the controller 50 operates the refrigerating cycle.

For example, the controller 50 may turn on the compressor 21 and rotate the refrigerating compartment fan 29. The controller 50 switches the switching valve 26 into a first state so that a refrigerant flows to the evaporator 25 for the refrigerating compartment.

When the refrigerating cycle is operated, the freezing compartment fan 28 maintains a stop state.

Accordingly, the refrigerant that has passed through the condenser 22 after being compressed by the compressor 21 flows to the evaporator 25 for the refrigerating compartment through the switching valve 26. The refrigerant that has vaporized through the evaporator 25 for the refrigerating compartment flows back into the compressor 21.

The air that has exchanged heat with the evaporator 25 for the refrigerating compartment is supplied to the refrigerating compartment 112. Accordingly, the temperature of the refrigerating compartment 112 decreases, but the temperature of the freezing compartment 111 may increase.

The controller 50 determines whether the stop condition of the refrigerating cycle is satisfied while the refrigerating cycle is operated (S3). That is, the controller 50 determines whether the start condition of the freezing cycle is satisfied.

For example, when the temperature of the refrigerating compartment 112 becomes the first refrigerating compartment reference temperature or less, the controller 50 may determine that the stop condition of the refrigerating cycle is satisfied. Further, when the temperature of the refrigerating compartment 112 becomes the second refrigerating compartment reference temperature or more, the controller 50 may determine that the start condition of the refrigerating cycle is satisfied.

When the start condition of the freezing cycle is determined as being satisfied, as the result of determination in step S3, the controller 50 operates the freezing cycle (S4).

For example, the controller 50 switches the switching valve 26 into a second state so that the refrigerant flows to the evaporator 24 for the freezing compartment. Even though the refrigerating cycle is changed into the freezing cycle, the compressor 21 keeps operating without stopping.

The controller 50 rotates the freezing compartment fan 28 and stops the refrigerating compartment fan 29.

The controller 50 may determine whether the stop condition of the freezing cycle is satisfied while the freezing cycle is operated (S5).

For example, when the temperature of the refrigerating compartment 112 becomes the second refrigerating compartment reference temperature or more, the freezing cycle may be stopped.

When the freezing cycle is stopped, the pump-down operation may be performed (S6). Unless the power of the refrigerator 1 is turned off, the controller 50 operates again the refrigerating cycle.

While the freezing cycle or the refrigerating cycle is operated, the controller 50 may determine whether it is required to defrost the evaporator.

On the other hand, referring to FIG. 4, while the freezing cycle or the refrigerating cycle is operated, the operation state of the refrigerator created on the basis of opening/closing information of the storage chamber door may be stored in the memory 45.

For example, the point in time when the storage chamber door is opened, the opening time of one-time opening, etc., may be accumulated and stored in the memory 45.

The controller 50 may determine the operation state of the refrigerator 1 for each unit time on the basis of the opening/closing information of the storage chamber door accumulated in the memory 45.

The operation state of the refrigerator 1 may be classified into a normal operation (an overuse period of the refrigerator) and a power saving operation.

For example, the controller 50 may determine an overuse period of the refrigerator 1 on the basis of information accumulated weekly or monthly.

Though not limited, the controller 50 may determine the days of the week and the hours when the number of times of opening of the storage chamber door for a unit time exceeds a reference number of times and/or the day of the week and the hours when the one-time opening time of the door exceeds a reference time as overuse periods.

The overuse period determined in this way may be changed in accordance with the accumulated opening information of the storage chamber door.

The overuse period may be determined as a normal operation period and the other period may be determined as a power saving operation period. The refrigerator 1 may be operated in accordance with operation states determined in advance for unit times.

That is, a past operation state of the refrigerator 1 is stored in the memory 45 to be expected as a future operation state of the refrigerator 1.

Accordingly, opening/closing of the door by a user may be expected in a normal operation period that will come later, in which the temperature of the storage chamber may be increased, so the cooling power of the compressor 21 may be maintained in the cooling cycle.

On the other hand, since the door may not be opened or the number of times of opening may be small in a power saving period that will come later, there is a less possibility of an increase in temperature of the storage chamber.

Accordingly, in this case, the temperature of the storage chamber may not increase or may increase slowly even though the cooling power of the compressor 21 is decreased, so power consumption may be reduced by decreasing the cooling power of the compressor 21.

Figure 5:
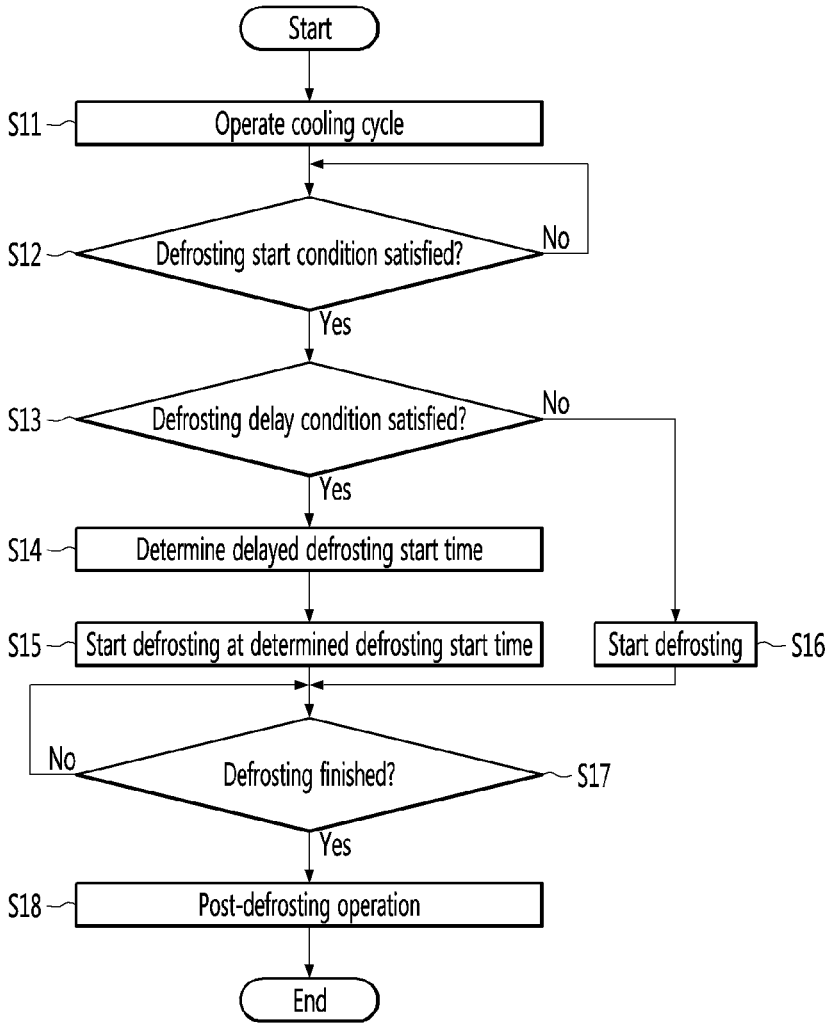
FIG. 5 is a flowchart illustrating a defrosting operation method according to an embodiment of the present disclosure.
Figure 6A:
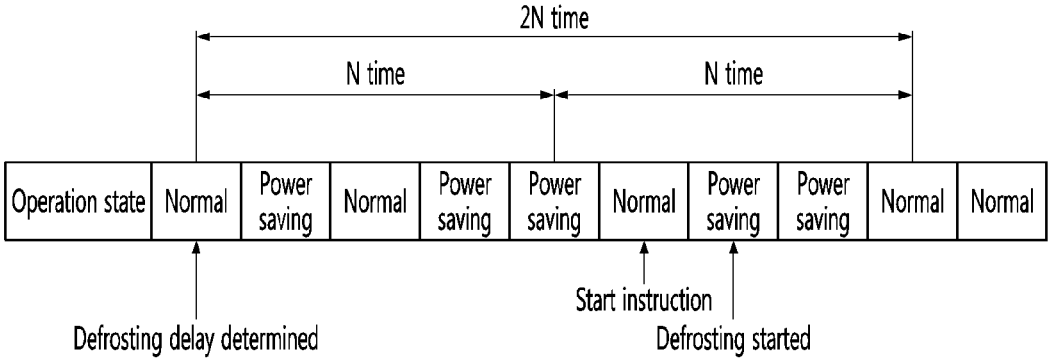
FIGS. 6A to 6C are views illustrating a point in time when defrosting is started after a defrosting delay condition is satisfied.
Figure 6B:
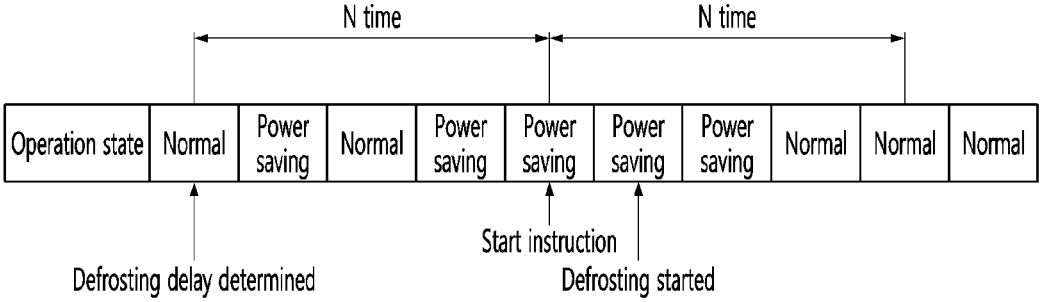
Figure 6C:
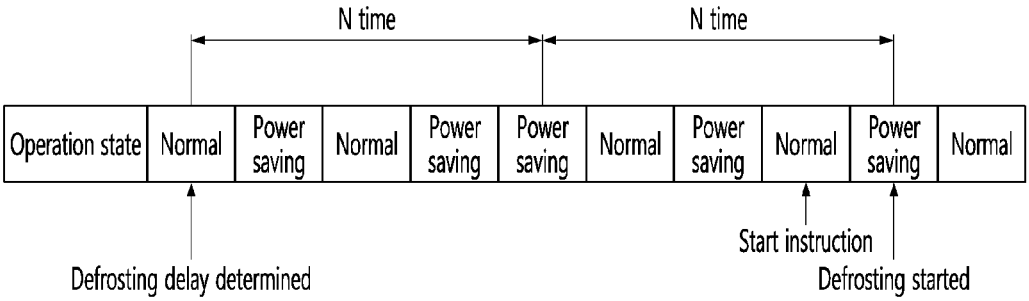

FIG. 5 is a flowchart illustrating a defrosting operation method according to an embodiment of the present disclosure; and FIGS. 6A to 6C are views illustrating a point in time when defrosting is started after a defrosting delay condition is satisfied.

Figure 7A:
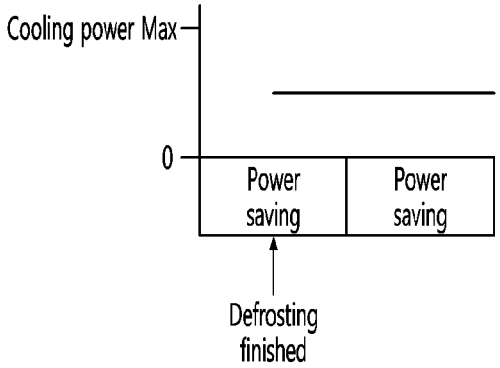
FIGS. 7A to 7C are views illustrating cooling power of a compressor in a post-defrosting operation according to an embodiment of the present disclosure.
Figure 7B:
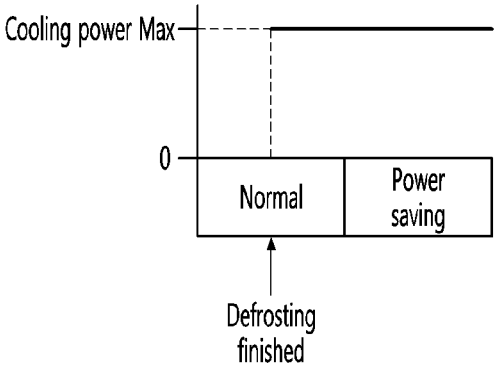
Figure 7C:
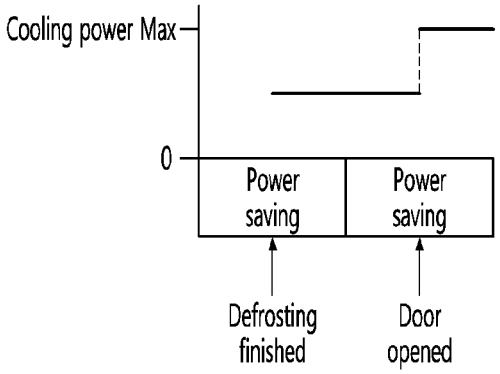

FIGS. 7A to 7C are views illustrating cooling power of a compressor in a post-defrosting operation according to an embodiment of the present disclosure.

Referring to FIGS. 5 to 7C, the cooling cycle is operated to cool the storage chamber (S11).

The controller 50 determines whether the defrosting start condition is satisfied while the cooling cycle is operated (S12).

As described above, the controller 50 may determine whether an accumulated operation time of the cooling cycle has reached the defrosting reference time.

When the defrosting start condition is satisfied, as the result of determination in step S12, the controller 50 may determine whether the defrosting delay condition is satisfied (S12).

A case in which the defrosting delay condition is satisfied is a case in which the accumulated operation time of the cooling cycle reaches the shortened reference time and a case in which the difference between the temperature of the storage chamber and the temperature sensed by the evaporator sensor is lower than the reference temperature.

That is, not only when the door is opened during the cooling cycle, but also when the difference between the temperature of the storage chamber and the temperature sensed by the evaporator sensor is lower than the reference temperature, the controller 50 may determine that the defrosting delay condition is satisfied.

The case in which the difference between the temperature of the storage chamber and the temperature sensed by the evaporator sensor is lower than the reference temperature, which may be a case in which the defrosting amount is less than a reference amount, may be a case in which defrosting is not needed at the current point in time (e.g., time of determination).

For example, as the defrosting amount on the evaporator increases, the evaporation temperature decreases, and accordingly, the temperature that is sensed by the evaporator sensor decreases.

Accordingly, as the defrosting amount increases, the difference between the temperature of the storage chamber and the temperature sensed by the evaporator sensor increases.

In this embodiment, when the defrosting amount is the reference amount or more, the controller 50 may determine that defrosting the evaporator is needed.

As a result, when the accumulated operation time of the cooling cycle reaches the shortened reference time, but the difference between the temperature of the storage chamber and the temperature sensed by the evaporator sensor is the reference temperature or more, to the controller 50 may immediately start defrosting without delaying defrosting.

On the contrary, when the accumulated operation time of the cooling cycle reaches the shortened reference time, but the difference between the temperature of the storage chamber and the temperature sensed by the evaporator sensor is lower than the reference temperature, to the controller 50 may determine to delay defrosting.

Depending on the kinds of refrigerators, the temperature sensor that senses the temperature of the storage chamber may be omitted. In this case, the controller 50 may determine whether to delay defrosting on the basis of a temperature change that is sensed by the evaporator sensor.

For example, the compressor 21 may be repeatedly turned on/off. When the compressor 21 is turned on, the temperature that is sensed by the evaporator sensor decreases, and when the compressor 21 is turned off, the temperature that is sensed by the evaporator sensor increases.

Since as the defrosting amount on the evaporator increases, the evaporation temperature decreases, the difference sensed by the evaporator sensor at the point in time when the compressor 21 is turned on (referred to as on-time point temperature) and temperature sensed by the evaporator sensor at the point in time when the compressor 21 is turned off (referred to as off-time point temperature) increases.

Accordingly, when the accumulated operation time of the cooling cycle reaches the shortened reference time and the difference between the on-time point temperature and the off-time point temperature of the evaporator sensor sensed by the evaporator sensor is lower than a set temperature value, the controller 50 may determine to delay defrosting.

When the defrosting delay condition is satisfied, as the result of determination in step S13, the defrosting operation is immediately started (S16). That is, the pre-defrosting step is performed, and then the defrosting step may be performed.

However, when the defrosting delay condition is satisfied, as the result of determination in step S13, the controller 50 may determine a delayed defrosting start time on the basis of the operation states for respective times stored in the memory 45 (S14). The controller 50 may start defrosting at the determined defrosting start time (S15). That is, the pre-defrosting step is performed at the determined defrosting start time, and then the defrosting step may be performed.

For example, the controller 50 may determine the delayed defrosting start time within a predetermined maximum delay time range.

In this specification, the unit time may be one hour and the maximum delay time range may be 2N hours. For example, N may be 4 in FIGS. 6A to 6C.

Referring to FIGS. 6A to 6C, operation states for respective unit times are stored in the memory 45, and for example, the defrosting delay condition may be determined as being satisfied in the normal operation period.

In this case, the controller 50 may determine a defrosting start time within the maximum delay time range (2N).

The controller 50 may determine first a defrosting start time in a period after a minimum delay time (N time).

When the defrosting delay time is satisfied, it may be possible to achieve the effect of reducing power consumption corresponding to defrosting delay when defrosting is started after the minimum delay time (N time) elapses.

Accordingly, the controller 50 may determine a defrosting start time in an available defrosting period after the minimum delay time (N time).

In this embodiment, the controller 50 may start defrosting in a period in which the power saving operation is started when the power saving operation period continues for two hours in the available defrosting period.

Referring to FIGS. 6A and 6B, a power saving operation period may continuously exist for two hours in the available defrosting period after the minimum delay time.

Then, the controller 50 may create a start instruction in a period immediately before the power saving operation period so that defrosting is started in the power saving operation period. When a unit time elapses after the instruction is created (for example, one hour elapses), defrosting may be started.

On the other hand, referring to FIG. 6C, when a power saving operation period that continues for two hours does not exist in the available defrosting period after the minimum delay time, the controller 50 may start defrosting immediately after the maximum delay time elapses.

That is, the controller 50 may create a start instruction one hour before the maximum delay time elapses. Then, defrosting may be started immediately when the maximum delay time elapses.

After the maximum delay time elapses, defrosting start may be required more than defrosting delay.

That is, defrosting delay is performed to reduce power consumption, but when a defrosting delay time increases, defrosting is delayed from the point in time when defrosting is needed. Accordingly, the cycle performance may deteriorate, and thus, the power consumption may increase.

Accordingly, the maximum delay time may be set such that defrosting is performed in a period in which a power saving operation period continues before the maximum delay time elapses, and defrosting is started immediately after the maximum delay time elapses when defrosting is not started within the maximum delay time range, whereby it may be possible to effectively reduce power consumption.

After the defrosting operation is started, the controller 50 may determine whether the defrosting operation is finished (S17). When determining that the defrosting operation is finished, the controller 50 may perform a post-defrosting operation (S18).

In this embodiment, the post-defrosting operation is an operation that decreases the temperature of the storage chamber by turning off the defrosting heater and operating the cooling cycle.

The reason that defrosting may be started when a power saving operation period continuously exists for two hours is for minimizing an additional increase of the temperature of the storage chamber, which increases after defrosting is finished, and for reducing power consumption.

For example, since the defrosting heater is operated and the cooling cycle is stopped during a defrosting operation, the temperature of the storage chamber may be increased by heat from the defrosting heater.

Accordingly, in general, when the defrosting operation is finished, the temperature of the storage chamber may be beyond a set temperature range.

In this case, it may be required to quickly decrease the temperature of the storage chamber after the defrosting operation is finished.

For example, it may be considered to operate the compressor 21 with maximum cooling power when the cooling cycle is operated after the defrosting operation is finished. In this case, it may be possible to quickly decrease the temperature of the storage chamber, but since the compressor 21 is operated with maximum cooling power, power consumption is high.

However, when a standby time until a user takes out food is long, it may be possible to maintain the temperature of the storage chamber (temperature of food) within a set temperature range before the user takes out the food even by operating the compressor 21 with cooling power smaller than the maximum cooling power without maximizing the cooling power of the compressor 21.

In this case, there is an advantage that although the temperature of the storage chamber slightly slowly decreases, power consumption is low because the cooling power of the compressor 21 is smaller than the maximum cooling power.

Accordingly, in this embodiment, when the point in time when the defrosting operation is finished is a power saving operation period and the next period is also a power saving operation period, the controller 50 may control the compressor 21 such that the compressor 21 is operated with cooling power lower than the maximum cooling power during the post-defrosting operation.

Referring to FIG. 7A, since the possibility that the door may be opened by a user is low in the power saving operation period, it may be possible to decrease the temperature of the storage chamber without influence by an increase in external temperature even by operating the compressor 21 with cooling power smaller than the maximum cooling power during the post-defrosting operation.

However, referring to FIG. 7B, a post-defrosting operation may be started in a normal operation period. In this case, the possibility that the door may be opened by a user is high during the post-defrosting operation.

The temperature of the storage chamber has been increased already during defrosting, and when the door is opened by a user, the temperature of the storage chamber is further increased.

In this state, if the compressor 21 is operated with cooling power smaller than the maximum cooling power, the temperature of the storage chamber slowly decreases and it may take a long time for the temperature of the storage chamber to enter a set temperature range.

Accordingly, when defrosting is finished and a post-defrosting operation is started in a normal operation period, the controller 50 may control the compressor 21 such that the compressor 21 operates with the maximum cooling power.

Further, even though a post-defrosting operation is started in a power saving operation period, if the next period is a normal operation period, the controller 50 may control the compressor 21 such that the compressor 21 operates with the maximum cooling power.

Meanwhile, referring to FIG. 7C, when opening of the door of the storage chamber is sensed while the compressor 21 is operated with cooling power smaller than the maximum cooling power, the controller 50 may control the compressor 21 to operate with the maximum cooling power.

When opening of the door of the storage chamber is sensed while the compressor 21 is operated with cooling power smaller than the maximum cooling power, an increase of the temperature of the storage chamber is expected, so the compressor 21 may be operated with the maximum cooling power to quickly decrease the temperature of the storage chamber.

Meanwhile, a case in which a first step is ended due to elapse of the limit time during the pre-defrosting step is a case in which a defrosting operation was started with the storage chamber at high temperature.

In this case, it is expected that the temperature of the storage chamber is high after defrosting is finished. Accordingly, when the first step is ended due to elapse of the limit time during the pre-defrosting step, the compressor 21 may be operated with the maximum cooling power even if the point in time when the defrosting operation was finished is a power saving operation and the next period is also a power saving period.

According to this embodiment, when defrosting delay is possible even if the defrosting start condition is satisfied, an increase in power consumption due to unnecessary defrosting may be prevented by delaying start of defrosting.

Further, according to this embodiment, it is possible to prevent an unnecessary increase in power consumption during a post-defrosting operation by determining the cooling power of the compressor on the basis of a refrigerator use pattern of a user after a defrosting operation is finished.

Although a defrosting operation method in a refrigerator including one compressor and two evaporators was exemplified in the above embodiment, the present disclosure is not limited thereto, and it should be noted that the defrosting operation method of this embodiment may be applied in the same way even to a refrigerator including one compressor and one evaporator and a refrigerator including two compressors and two evaporators, etc.

What is claimed is:

1. A method of controlling a refrigerator that comprises a controller, a compressor, an evaporator to supply cold air to a storage chamber, and a defrosting heater to defrost the evaporator, the method comprising:

operating a cooling cycle for cooling the storage chamber;

determining, by the controller, whether a defrosting start condition is satisfied during operation of the cooling cycle;

determining, by the controller, whether a defrosting delay condition is satisfied when the defrosting start condition is satisfied; and starting, by the controller, a defrosting operation when the defrosting delay condition is not satisfied, and starting the defrosting operation at a delayed defrosting start time when the defrosting delay condition is satisfied, wherein the method further comprising:

sensing, by an evaporator sensor, a temperature associated with the evaporator; and sensing, by a temperature sensor, a temperature of the storage chamber, wherein the defrosting delay condition is satisfied when a difference between the temperature of the storage chamber sensed by the temperature sensor and the temperature associated with the evaporator sensed by the evaporator sensor is less than a reference temperature value.

2. The method of claim 1, wherein the defrosting start condition is satisfied when an accumulated operation time of the cooling cycle reaches a defrosting reference time.

3. The method of claim 2, wherein the defrosting reference time is reduced based on an opening time of a door that opens and closes the storage chamber, and the defrosting start condition is satisfied when the accumulated operation time of the cooling cycle reaches a reduced reference time.

4. The method of claim 1, further comprising:

determining, by the controller, a delayed defrosting start time within a predetermined maximum delay time range.

5. The method of claim 4, further comprising:

determining, by the controller, the delayed defrosting start time within a time period after a minimum delay time period in the maximum delay time range.

6. The method of claim 5, further comprising:

storing in a memory an operation state of the refrigerator for each unit time on a basis of opening information of a door that opens and closes the storage chamber;

storing in the memory, a power saving operation state or a normal operation state of the refrigerator for each unit time; and determining, by the controller, the delayed defrosting start time such that a defrosting operation is started in a period in which power saving periods continuously exist.

7. The method of claim 6, wherein when a power saving period does not continuously exist in a time period after the minimum delay time period, the controller controls the defrosting operation to be started after the maximum delay time elapses.

8. The method of claim 1, further comprising:

determining, by the controller, whether the defrosting operation is finished; and performing, by the controller, a post-defrosting operation when the defrosting operation is finished.

9. The method of claim 8, further comprising:

controlling, by the controller, the compressor such that the compressor operates with cooling power lower than maximum cooling power during the post-defrosting operation.

10. The method of claim 9, wherein when opening of a door of the storage chamber is sensed while the compressor operates with a cooling power lower than the maximum cooling power, the controller controls the compressor such that the compressor operates with the maximum cooling power.

11. The method of claim 9, further comprising:

storing in a memory an operation state of the refrigerator for each unit time on a basis of opening information of a door that opens and closes the storage chamber; and storing in the memory, a power saving operation state or a normal operation state of the refrigerator for each unit time, wherein at a point in time when the defrosting operation is finished is a power saving operation period and a next period is also a power saving operation period, the controller controls the compressor such that the compressor operates with cooling power lower than the maximum cooling power in the post-defrosting operation.

12. The method of claim 9, further comprising:

storing in a memory an operation state of the refrigerator for each unit time on a basis of opening information of a door that opens and closes the storage chamber; and storing in the memory a power saving operation state or a normal operation state of the refrigerator for each unit time, wherein when the post-defrosting operation is started in the normal operation period or when the post-defrosting operation is started in the power saving operation period and a next period is a normal operation period, the controller controls the compressor such that the compressor operates with the maximum cooling power.

13. A refrigerator comprising:

an evaporator to supply cold air to a storage chamber;

a defrosting heater to defrost the evaporator;

a controller to control the defrosting heater; and an evaporator sensor to sense a temperature associated with the evaporator, wherein the controller is configured to determine whether a defrosting start condition is satisfied, determine whether a defrosting delay condition is satisfied when the defrosting start condition is satisfied, start a defrosting operation when the defrosting delay condition is not satisfied, and determine a delayed defrosting start time and start the defrosting operation at the delayed defrosting start time when the defrosting delay condition is satisfied, wherein the defrosting delay condition is satisfied when a difference between the temperature of the storage chamber sensed by a temperature sensor and the temperature associated with the evaporator sensed by the evaporator sensor is less than a reference temperature value, or a difference between the temperature associated with the evaporator sensed by the evaporator sensor at a point in time when a compressor is turned on and the temperature associated with the evaporator sensed by the evaporator sensor at a point in time when the compressor is turned off is less than the reference temperature value.

14. The refrigerator of claim 13, wherein the defrosting start condition is satisfied when an accumulated operation time of the cooling cycle reaches a defrosting reference time.

15. The refrigerator of claim 14, further comprising:

a door to open and close the storage chamber, wherein the defrosting reference time is reduced on a basis of an opening time of the door, and the defrosting start condition is satisfied when the accumulated operation time of the cooling cycle reaches a reduced reference time.

16. The refrigerator of claim 13, wherein the controller determines a delayed defrosting start time within a predetermined maximum delay time range.

17. The refrigerator of claim 16, wherein the controller determines the delayed defrosting start time within a time period after a minimum delay time period in the maximum delay time range.

18. A method of controlling a refrigerator that comprises a controller, a compressor, an evaporator to supply cold air to a storage chamber, and a defrosting heater to defrost the evaporator, the method comprising:

operating a cooling cycle for cooling the storage chamber;

determining, by the controller, whether a defrosting start condition is satisfied during operation of the cooling cycle;

determining, by the controller, whether a defrosting delay condition is satisfied when the defrosting start condition is satisfied; and starting, by the controller, a defrosting operation when the defrosting delay condition is not satisfied, and starting the defrosting operation at a delayed defrosting start time when the defrosting delay condition is satisfied, wherein the method further comprising:

sensing, by an evaporator sensor, a temperature associated with the evaporator, and the compressor is turned on or off during an operation of the cooling cycle, wherein the defrosting delay condition is satisfied when a difference between the temperature associated with the evaporator sensed by the evaporator sensor at a point in time when the compressor is turned on and the temperature associated with the evaporator sensed by the evaporator sensor at a point in time when the compressor is turned off is less than a reference temperature value.

* * * * *